US005452592A

United States Patent [19]

Kobata et al.

[11] Patent Number: 5,452,592

[45] Date of Patent: Sep. 26, 1995

[54] METHOD OF TREATING A YARN END OF A KNITTED FABRIC

[75] Inventors: Yoshiyuki Kobata, Wakayama; Kazuyoshi Okamoto, Gose, both of Japan

[73] Assignee: Shima Seiki Manufacturing Limited, Wakayama, Japan

[21] Appl. No.: 263,205

[22] Filed: Jun. 21, 1994

[30] Foreign Application Priority Data

Jun. 23, 1993 [JP] Japan ..... 5-151947

[51] Int. Cl.[6] ..... D04B 1/24

[52] U.S. Cl. ..... 66/176; 66/60 R

[58] Field of Search ..... 66/176, 201; 2/239; 28/170

[56] References Cited

U.S. PATENT DOCUMENTS

| | | | |
|---|---|---|---|
| 2,164,289 | 6/1939 | Holmes | 2/239 X |
| 4,624,115 | 11/1986 | Safrit et al. | 66/176 X |
| 4,920,769 | 5/1990 | Rickerl | 66/176 |
| 5,031,424 | 7/1991 | Peleg et al. | 66/176 |
| 5,081,854 | 1/1992 | Lonati | 66/176 |

*Primary Examiner*—John J. Calvert
*Attorney, Agent, or Firm*—Baker & Botts

[57] ABSTRACT

In knitting a knit fabric, knitting needles in a range corresponding with a desired knitting width for the fabric are fed with a draw yarn to form a course of stitches from the draw yarn. The knitting needles may be taken from a pair of needle beds which are sometimes referred to as the front bed and the rear bed. All or part of the knitting needles used for knitting the draw yarn are next fed with a knitting yarn and a course of stitches form from the knitting yarn. Thereafter, knitting needles from the front and rear needle beds in the range corresponding with the desired knitting width are fed with the knitting yarn and the initial portion of the fabric is knitted. Subsequently, knitting needles from either the front or rear needle beds are fed with knitting yarn and thereafter knitting needles from another needle bed are fed with knitting yarn to knit plan tubular stitches until the fabric is completed. The draw yarn is drawn out of the fabric after completion of the knitting. Next, a yarn end remaining at the initial portion is pulled from the fabric and cut near a side end of the initial portion of the fabric will also be contracted by pulling the yarn end. The cut end is pulled back into the initial portion of the fabric by expanding the contracted portion to its original shape.

10 Claims, 7 Drawing Sheets

METHOD OF TREATING A YARN END OF A KNITTED FABRIC

TECHNICAL FIELD OF THE INVENTION

The present invention relates to a method of treating a yarn end which presents in the knitting start portion (hereinafter described as "initial portion") of a fabric knitted by the use of a flat knitting machine.

BACKGROUND OF THE INVENTION

In the case of knitting with a flat knitting machine, the following steps are usually taken at the beginning of knitting. A knitting yarn is fed into a knitting region by a yarn feeder for guiding the knitting yarn to knitting needles on a needle bed in such a state that a yarn end of the knitting yarn is held by a yarn end holder arranged outside the knitting region in a lateral direction of the needle bed on the top face of which a plurality of knitting needles are implanted. Subsequently a suitable quantity of courses are knitted. Thereafter the yarn end held by the yarn end holder is released and pulled down with the knitted fabric in such a state that the yarn end is associated with the initial portion of the knitted fabric. In the fabric knitted in such manner, a portion of the knitting yarn which exists from the yarn end held by the yarn end holder to the position actually fed to the knitting needles is not knitted into the knitted fabric, and becomes a yarn end portion exposed outside the knitted fabric along the initial portion.

In the case of knitting an attachment piece to be sewn together with a piece such as a collar or front body for the purpose of reinforcement, the attachment pieces are usually knitted by continuous knitting. The continuous knitting means continuously knitting such attachment pieces having a predetermined length one by one without cutting the knitting yarn in a state that the respective attachment pieces are connected with one another via a draw yarn. When such continuous knitting is conducted, a yarn is left among the knitted attachment pieces at an interval of a course knitted by the draw yarn. After knitting the attachment pieces is completed, the draw yarn connecting the attachment pieces is cut and removed, and the yarn among the knitted attachment pieces is cut in order to separate the respective knitted attachment pieces from one another. As a result, the cut yarn remains at the initial portion of each attachment piece and exposed itself outside the knitted attachment piece.

In order to treat the yarn end remaining at the initial portion of these knitted fabrics, the yarn end is conventionally pulled into the initial portion of each knitted fabric using a crochet needle after the completion of knitting with a knitting machine.

In such a conventional manner, it is necessary to insert the crochet needle into the knitted fabric in order to pull the yarn end into the knitted fabric. However, it is hard to insert the crochet needle into tight loops of stitches, and when the crochet needle is forcibly inserted into the loops of the knitted fabric, the loops become loose, which damages the commercial value of the knitted fabric.

Besides, technical skill is required to conduct the operations of the manner with a crochet needle. For example, operations carried out by those unskilled in the manner might cause fraying of a yarn end. Thus, such treatment manner of the yarn end with a crochet needle is not an effective and successful treatment which can be achieved regardless of the level of operator's skill.

SUMMARY OF THE INVENTION

In view of the above problem, an object of the invention is to provide a method of treating a yarn end of a knitted fabric which can enhance working efficiency as well as can be successfully and easily conducted without a special tool like a crochet needle even by those unskilled.

In order to achieve the object, the method of treating a yarn end of the invention is practiced in a flat knitting machine wherein at least a pair of needle beds either or both of which can be moved right and left are arranged in front and in rear, and comprises the following steps.

Firstly, knitting needles provided in one of the pair of needle beds and positioned in a range corresponding with the knitting width of a desired fabric are fed with a draw yarn to form at least one course of stitches. Secondly all or a part of the knitting needles used for knitting the draw yarn are fed with a knitting yarn to form at least one course of stitches, and subsequently the knitting needles provided in the front and rear needle beds are fed with the knitting yarn to begin knitting of rib stitches. Then the knitting needles of either the front or rear needle bed are fed with the knitting yarn in order to knit a successive course, and thereafter the knitting needles of the other needle bed are fed with the knitting yarn to knit firstly tubular plain stitches and then desired stitches. After the completion of knitting a desired fabric, the knitted fabric is taken out from the flat knitting machine, and then the draw yarn is drawn from the knitted fabric. Thereafter a yarn end remaining at the initial portion is pulled out from the knitted fabric, and the yarn end pulled out is cut in a region near a side end of the knitted fabric in such a state that the initial portion is contracted. The yarn end remaining at the initial portion after the cutting is pulled back into the initial portion of the knitted fabric.

Besides, the method of the invention is characterized in that after knitting a draw yarn only a suitable number of knitting needles positioned at a side end of a knitting width are fed with a knitting yarn for knitting a desired fabric.

Accordingly to the invention, drawing out a draw yarn from a knitted fabric is carried out after taking out the knitted fabric from the flat knitting machine. Subsequently, a yarn end at the initial portion of the knitted fabric is pulled, and thereby the courses of knitting yarn loops knitted prior to the commencement of knitting rib stitches after knitting the draw yarn are raveled and return to a straight line yarn. The straight line yarn is drawn out from the knitted fabric in such a state that the straight line is penetrated among front and back loops of a rib stitches course of the initial portion. The yarn end is further pulled and then cut in a position near a side end of the knitted fabric in such a state that the initial portion is contracted. Subsequently the contracted initial portion is expanded so that the contraction thereof is loosed and the yarn end drawn out from the knitted fabric is pulled into the knitted fabric and held therein as the contraction is loosed.

The method of treating a yarn end of the invention is characterized in that, prior to the commencement of knitting a desired fabric, firstly a course of draw yarn is knitted, and successively a course of knitting yarn for the purpose of inserting a yarn end thereinto is knitted. A knitted fabric is separated from waste stitches or from a successively knitted fabric by drawing out the knitted draw yarn. Treatment of the yarn end is conducted by cutting the yarn end in such a state that the yarn end is pulled so that it can be later drawn into the knitted fabric. The operation can be very easily carried out without a crochet needle, so that the step of inserting a crochet needle into tight loops of stitches is eliminated. Accordingly, there does not arise the problem that the loops of stitches become loose due to forcibly inserting a crochet needle into the tight loops of stitches and the commercial value of the knitted fabric is not damaged.

Further, if a portion knitted of end yarn having a width equal to that of a fabric to be knitted is formed prior to knitting the initial portion of the fabric, a portion to be inserted into the knitted fabric will be held in the knitted fabric in such a state that the portion is penetrated between front and rear loops of a rib stitches course of the initial portion knitted thereafter. Accordingly, the yarn end can be surely held without raveling and the initial portion of the knitted fabric can be reinforced.

Further, when only a suitable number of knitting needles positioned at a side end of a knitting width are fed with a yarn to be used for knitting a fabric after feeding the knitting needles with a draw yarn, it is not necessary to feed the knitting needles positioned in the entire knitting width with the knitting yarn. As a result, yarn saving can be achieved.

Further, by virtue of the use of the draw yarn, the application of the invention is not limited to knitting one piece, which is conducted in fashioning, and continuous knitting where attachment pieces are continuously knitted without cutting a knitting yarn during a knitting operation is also included in the scope of the application of the invention.

BRIEF DESCRIPTION OF THE DRAWINGS

Other and further objects, features, and advantages of the invention will be more explicit from the following detailed description taken with reference to the drawings wherein.

DETAILED DESCRIPTION OF THE INVENTION

Figure 1:
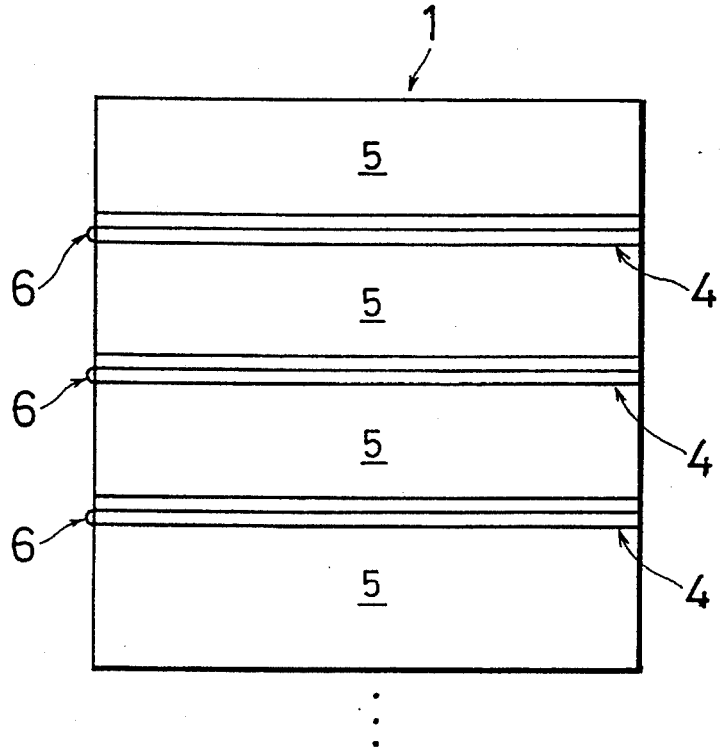
FIG. 1 is a schematic diagram of attachment pieces knitted continuously on the basis of a method of treating a yarn end of the invention.

Now referring to the drawings, the yarn end treatment method of the invention will be described in detail.

FIG. 1 shows knitted attachment pieces 5 to be seamed to a suitable portion of a front body or collar for the purpose of reinforcement. It shows the state of a knitted fabric 1 after the completion of knitting which has been conducted so that the method of treating a yarn end of the invention might be applied in the case where knitting is continuously conducted without cutting a knitting yarn by connecting the knitted attachment pieces via a draw yarn 4 with one another. The knitted fabric 1 comprises a draw yarn 4, attachment pieces 5, and a yarn 6. The yarn 6 connects the end of one attachment knit piece 5 with the beginning of the following attachment knit piece 5.

Figure 2:
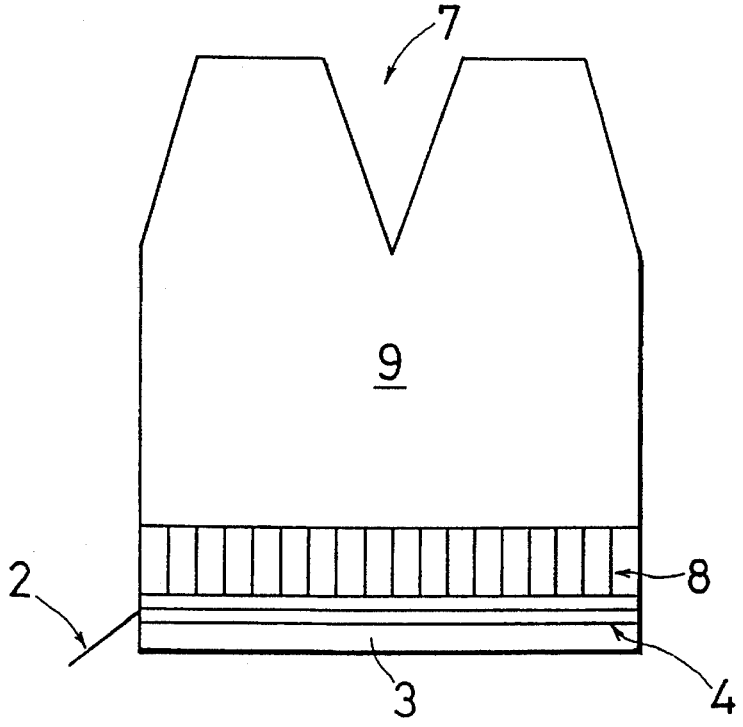
FIG. 2 is a schematic diagram of a one fashioned piece singly knitted on the basis of a method of treating yarn end of the invention.

FIG. 2 shows a state of a knit fabric 7 after the completion of knitting wherein a method of treating a yarn end of the invention is employed for fashioning. The knit fabric 7 comprises a yarn end 2, waste stitches 3, a draw yarn 4, bottom rib stitches 8, and a main portion 9. The draw yarn 4 is used in order to separate the waste stitches 3 from the knit fabric 7 and for this purpose is preferably employed a smooth machine sewing thread or the like. A yarn of lower cost than that of a knitting yarn is used for knitting the waste stitches 3. Satisfactory stitches can not be obtained when knitting is started from a state that stitches are engaged with knitting needles of neither a front nor a rear needle bed. If the waste stitches 3 are knitted prior to knitting the knit fabric 7, satisfactory stitches can be obtained from the beginning of knitting the knit fabric 7 because the stitches are knitted successively after the waste stitches of the preceding course. Additionally, the fabric is hardly damaged when the draw yarn 4 is drawn out in order to separate the knit fabric from the waste stitches.

In the case of the knit fabric 1 as shown in FIG. 1, the yarn ends (not shown) will remain in the initial portion of each attachment knit fabric 5 as a result of drawing out the draw yarn 4 connecting the attachment knit pieces 5 with one another and cutting the connecting yarn 6 connecting the attachment knit pieces 5, and the state of the initial portion of the knit fabric 1 is almost the same as that of the knit fabric as shown in FIG. 2. In this embodiment, the cut connecting yarn 6 among the respective attachment knit fabrics 5 will be explained as a yarn end 2 in order to simplify the explanation, and knitting the knit fabric 1 as shown in FIG. 1 will be explained as an example in the following.

Figure 3A:
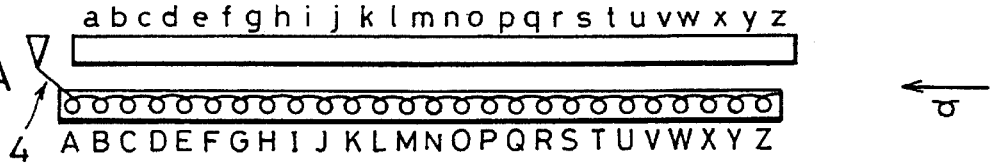
FIGS. 3A–3F are knitting courses diagrams showing a first embodiment of the invention.
Figure 3B:
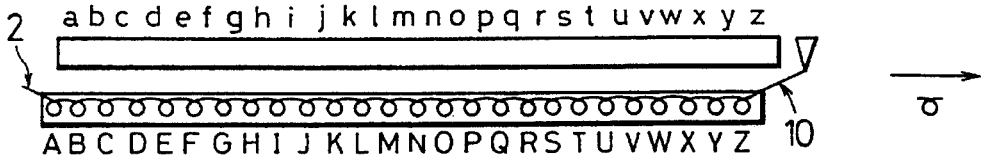

First, the first embodiment of the invention will be described. In the method of treating a yarn end of the invention, waste stitches are knitted on both of the front and rear needle beds prior to knitting a desired fabric. As shown in FIG. 3A, the width from a needle A to a needle Z on the front needle bed corresponds with the width of a desired fabric and the needles A–Z are fed with a draw yarn 4 by a yarn feeder, and stitches are knitted. Subsequently, as shown in FIG. 3B, the needles A–Z on the front needle bed are fed by the yarn feeder with a knitting yarn 10 for knitting a fabric and stitches for the purpose of yarn end treatment described below are knitted.

Figure 3C:
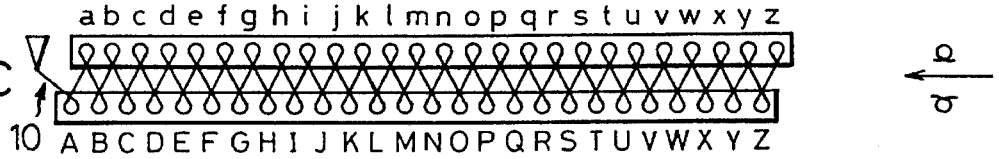
Figure 3D:
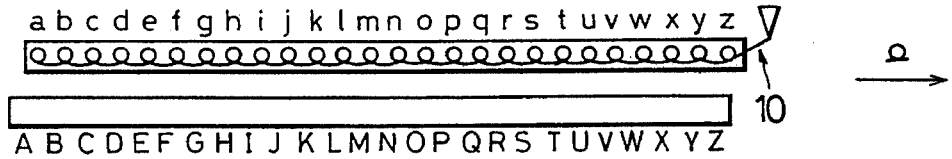
Figure 3E:
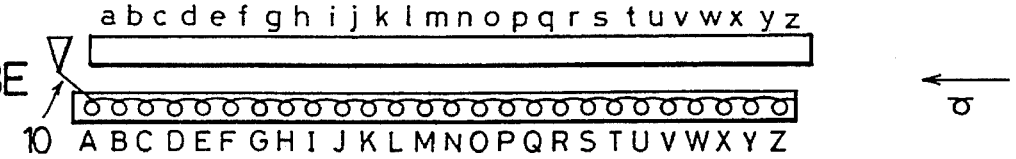
Figure 3F:
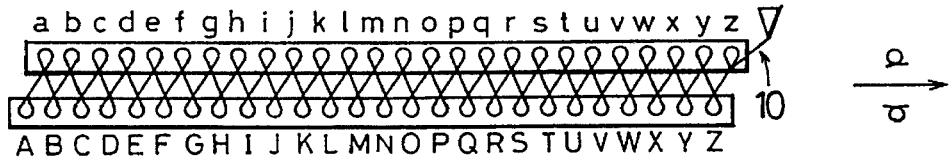

In FIG. 3C, the needles on the front needle bed and those on the rear needle bed are alternately fed with a knitting yarn by the yarn feeder to begin knitting rib stitches of 1×1 over the entire width of the desired fabric. Subsequently, as shown in FIGS. 3D, 3E, after the needles on either the front or the rear needle bed is fed with the knitting yarn 10, the needles on the other of the front and the rear needle bed are fed therewith and knit tubular stitches are knitted. Further, as shown in FIG. 3F, the needles on the front needle bed and those on the rear needle bed are alternately fed with the knitting yarn and knit rib stitches of 1×1 are knitted. In this embodiment, an initial course as shown in FIG. 3C is knitted by the use of all the needles, A–Z and a–z. It is needless to say, however, that the knitting of an initial course might be suitably changed in correspondence with the kinds of stitches such as tubular stitches, rib stitches of 1×1 , rib stitches of 2×1.

After knitting the courses as shown in FIG. 3A–3F is completed, an attachment knit piece 5 is knitted. The knit fabric 1 shown in FIG. 1 wherein the respective attachment knit pieces 5 are connected with one another by the draw yarn 4 is obtained by repeating the above knitting steps.

Figure 4A:
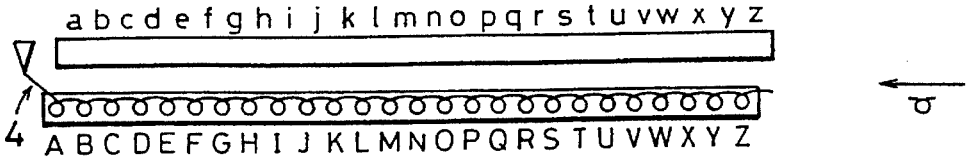
FIGS. 4A–4G are knitting courses diagrams showing a second embodiment of the invention.
Figure 4B:
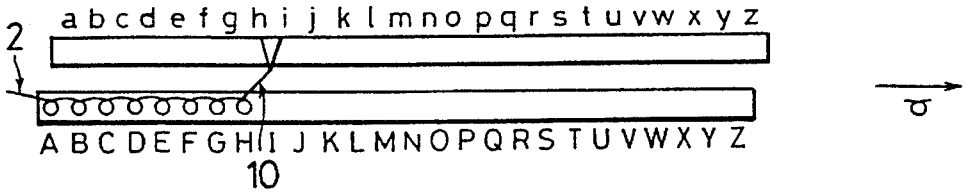
Figure 4C:
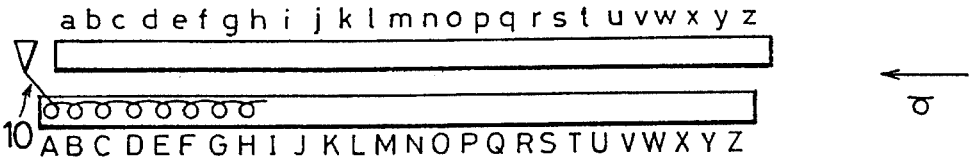

Secondly, the second embodiment of the invention will be described on the basis of the knitting courses diagrams shown in FIGS. 4A–4G. The second embodiment is different from the first one in the portions as shown in FIGS. 4B, 4C. In the case of the first embodiment, the needles A–Z are fed with the draw yarn as shown in FIG. 3A and thereafter, as shown in FIG. 3B, the needles are fed with the yarn 10 over the entire width of the fabric to be knitted prior to alternately feeding the needles of each of the front needle bed and those of the rear needle with the knitting yarn 10 to begin knitting as shown in FIG. 3C. On the other hand, in the case of the second embodiment, the needles A–Z positioned in the range of the entire width of a fabric to be knitted are fed with the draw yarn 4 by a yarn feeder as shown in FIG. 4A, and thereafter only a predetermined number of needles A–H of the needles on the front bed fed with the draw yarn as shown in FIG. 4A, which are positioned on a side end of the fabric width, are fed with the knitting yarn 10 for knitting the attachment knit pieces 5 as shown in FIG. 4B. Subsequently, as shown in FIG. 4C, the yarn feeder is turned from the state shown in FIG. 4B and the needles H–A, which are the same as those fed with the knitting yarn 10 in FIG. 4B, are fed with the knitting yarn 10. Subsequent steps of knitting courses are conducted, as shown in FIGS. 4B–4G, in the same manner as that shown in FIGS. 3C–3F for the first embodiment. After the completion of the steps of knitting courses shown in FIGS. 4B–4G, attachment pieces 5 are knitted in the same manner as that of the first embodiment. The knit fabric 1 shown in FIG. 1 wherein the respective attachment knit pieces 5 are connected with one another by the draw yarn 4 is obtained by repeating the above knitting steps.

As shown in FIGS. 3D–3E, the needles on each of the front and rear needle beds are fed with the knitting yarn and thereby one course of tubular stitches is knitted on each needle bed. That is for the purpose of holding loops of rib stitches. For example, it is possible that the needles on the rear needle bed are once more fed with the knitting yarn in subsequence to knitting the course shown in FIG. 4F, and thereafter the course shown in FIG. 4G is knitted.

In the second embodiment, the needles A–H positioned on a side end of the knitting width are fed with a knitting yarn 10 for knitting a course shown in FIG. 4B. The number of the needles on the side end to be fed with the knitting yarn 10 can be freely predetermined.

Subsequently, the steps of the method of treating a yarn end after the completion of knitting a fabric with a knitting machine will be described.

Figure 5:
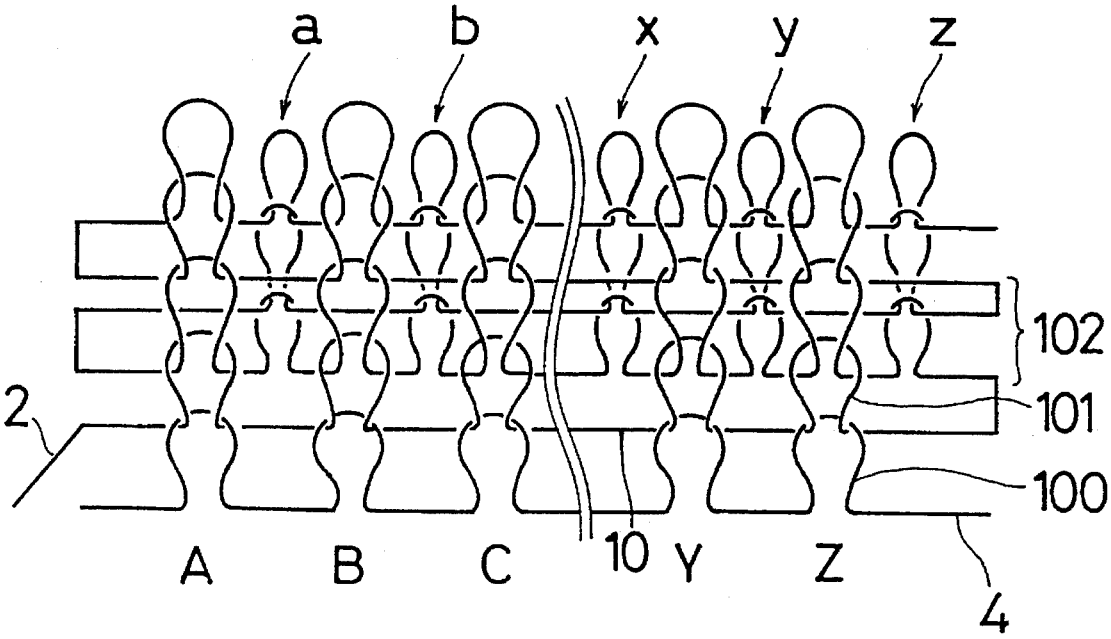
FIG. 5 is a loop diagram showing an initial portion of a fabric knitted on the basis of the first embodiment of the invention.

In the case of a knit fabric knitted in the manner of the first embodiment for the purpose of applying the method of treating a yarn end, after the fabric has been knitted so that the method of treating a yarn end can be applied, a yarn 6 connecting respective attachment knit pieces 5 with one another is cut off. Thereby the initial portion of each attachment knit piece 5 is put into such a state as shown in FIG. 5 (FIG. 5 shows only loops formed by knitting courses as shown in FIGS. 3A–3F), and the yarn 6 remaining in each attachment knit piece 5 yet after the cutting-off exists as a yarn end 2. In this state, in order to separate the attachment knit pieces 5 from one another, the draw yarn 4 is drawn out in the same manner as that for a fabric knitted in a conventional knitting method. Subsequently, the yarn end 2 existing at the initial portion of each attachment piece 5 is pulled in a direction of drawing out from the knit fabric (wale direction). Thereby, the loop shape of the loops knitted as a course 101 in FIG. 3B, which is maintained by the loops of the draw yarn 4 knitted as a course 100 in FIG. 3A, can not be maintained anymore and the loops of the course 101 come to ravel out as the yarn end 2 is pulled.

Figure 6:
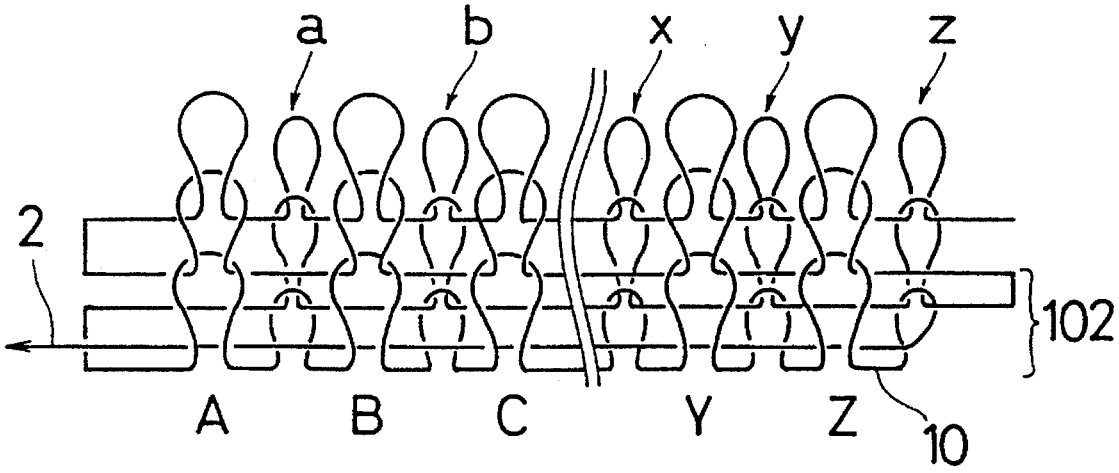
FIG. 6 is a loops diagram showing an initial portion of a fabric knitted on the basis of the first embodiment of the invention in a state that a yarn end of the fabric is pulled.

The loops of the course 101 in FIG. 3B come to ravel out over the entire knitting width in the direction from a needle A to a needle Z in order by further pulling the yarn end 2. When the raveling-out comes up to the loop formed by the needle Z, the loops of the course 102 in FIG. 3C knitted in succession to the course in FIG. 3B can be maintained without raveling out even when the loops of the preceding course is in a raveled state, because the course 102 is of rib stitches. Consequently, the state of the loops is as shown in FIG. 6.

Subsequently, when, in a state that the raveling-out of the loops does not occur anymore, the yarn end 2 is further pulled in such a direction that the yarn end 2 is drawn out from the knitted fabric 5, the loops of the course 102 in FIG. 3C are tightened in itself, because the raveling out of the loops is stopped in the position of a needle Z of the rear needle bed. Then the yarn end 2 is cut in a position near the side end of the attachment knit piece 5 in such a state that the initial portion of the attachment knit piece 5 is contracted. Thereafter, when the initial portion of the attachment knit piece 5 is expanded in such a direction that the contraction of thereof is loosed, the cut end of the yarn end 2 extruding from the knitted fabric is pulled into the knitted fabric as the contraction is loosed, and held therein. The yarn end 2 is treated in such manner.

Additionally, in this embodiment, the yarn raveled by pulling the yarn end is considered as a part of the yarn end 2 for convenience of explanation.

Figure 7:
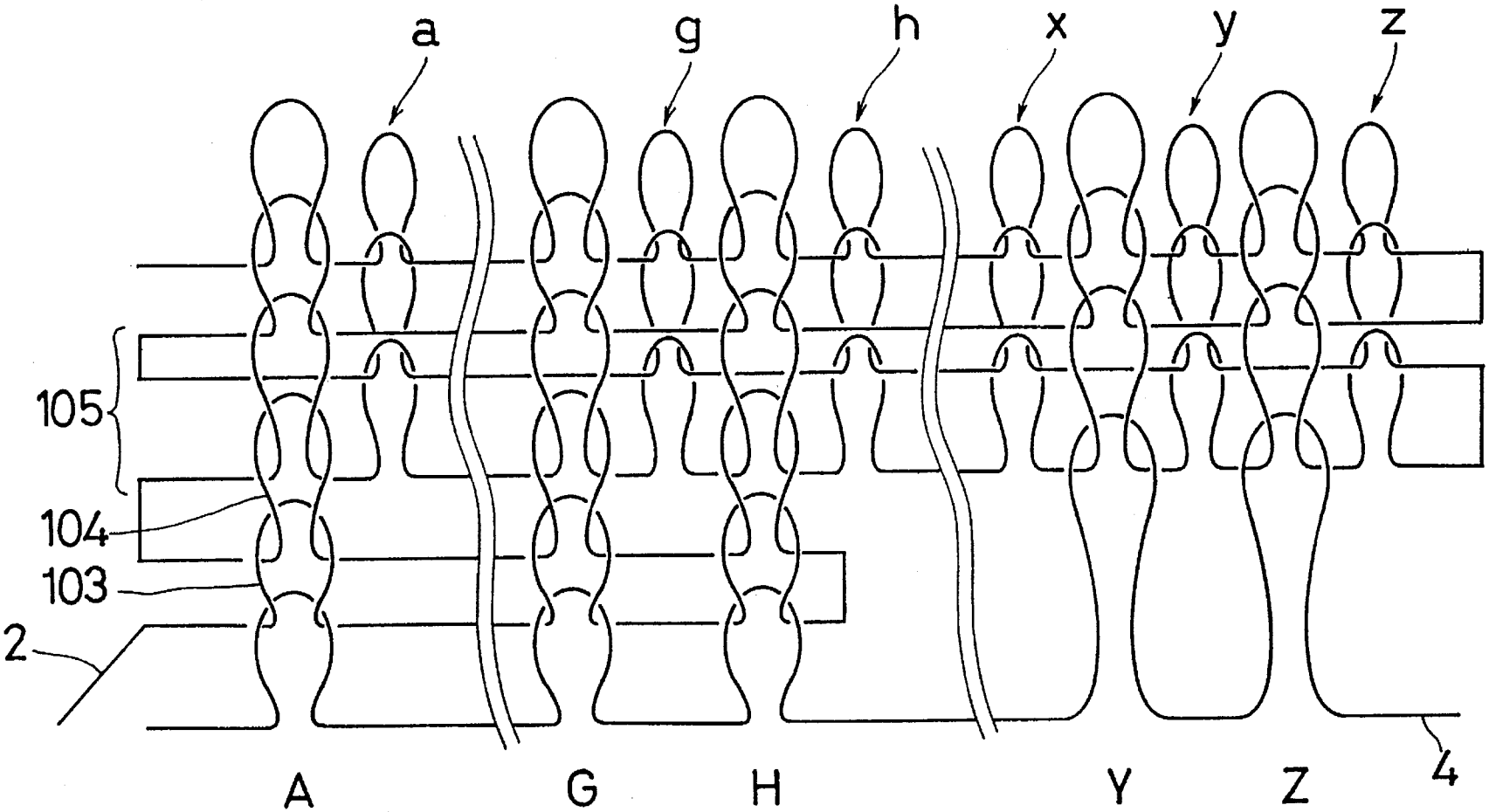
FIG. 7 is a loops diagram showing an initial portion of a fabric knitted on the basis of the second embodiment of the invention.
Figure 8:
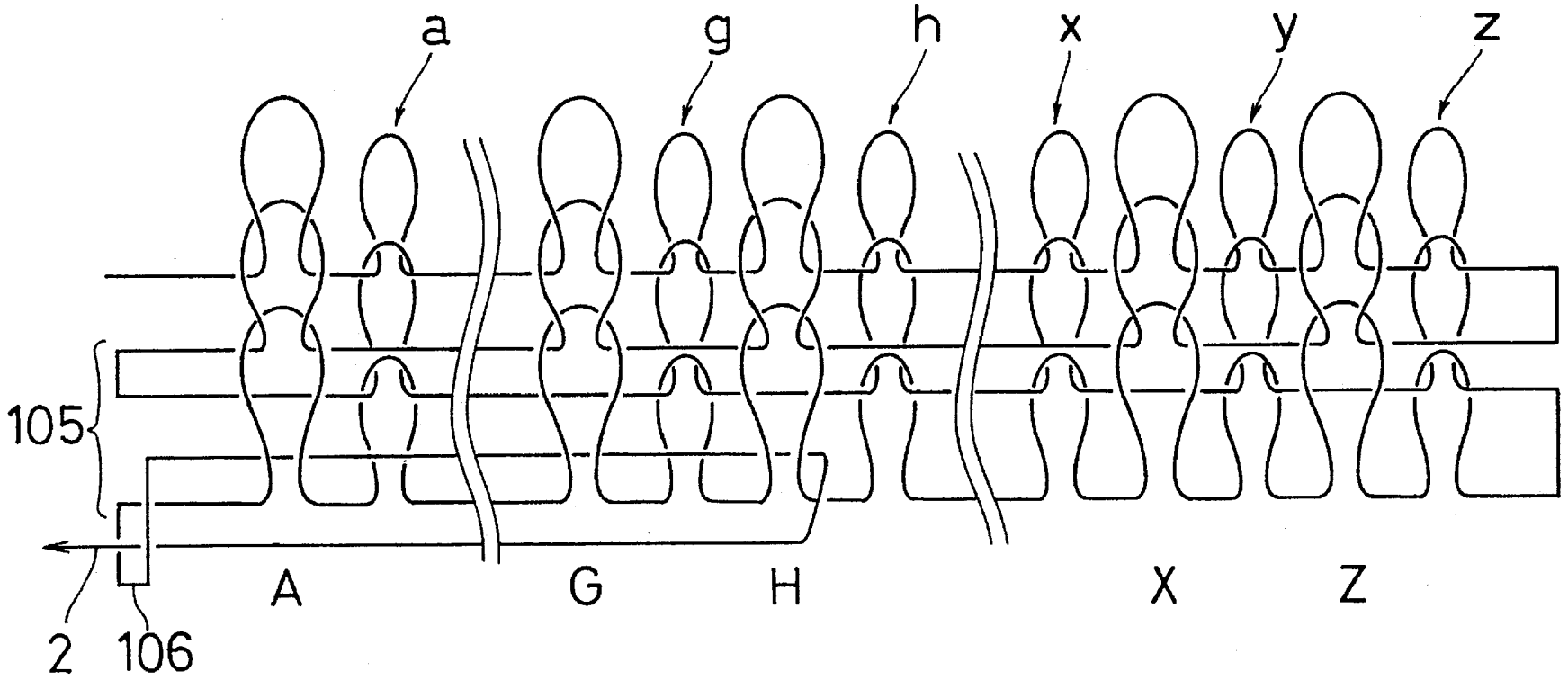
FIG. 8 is a loops diagram showing an initial portion of a fabric knitted on the basis of the second embodiment of the invention in a state that a yarn end of the fabric is pulled.
Figure 9:
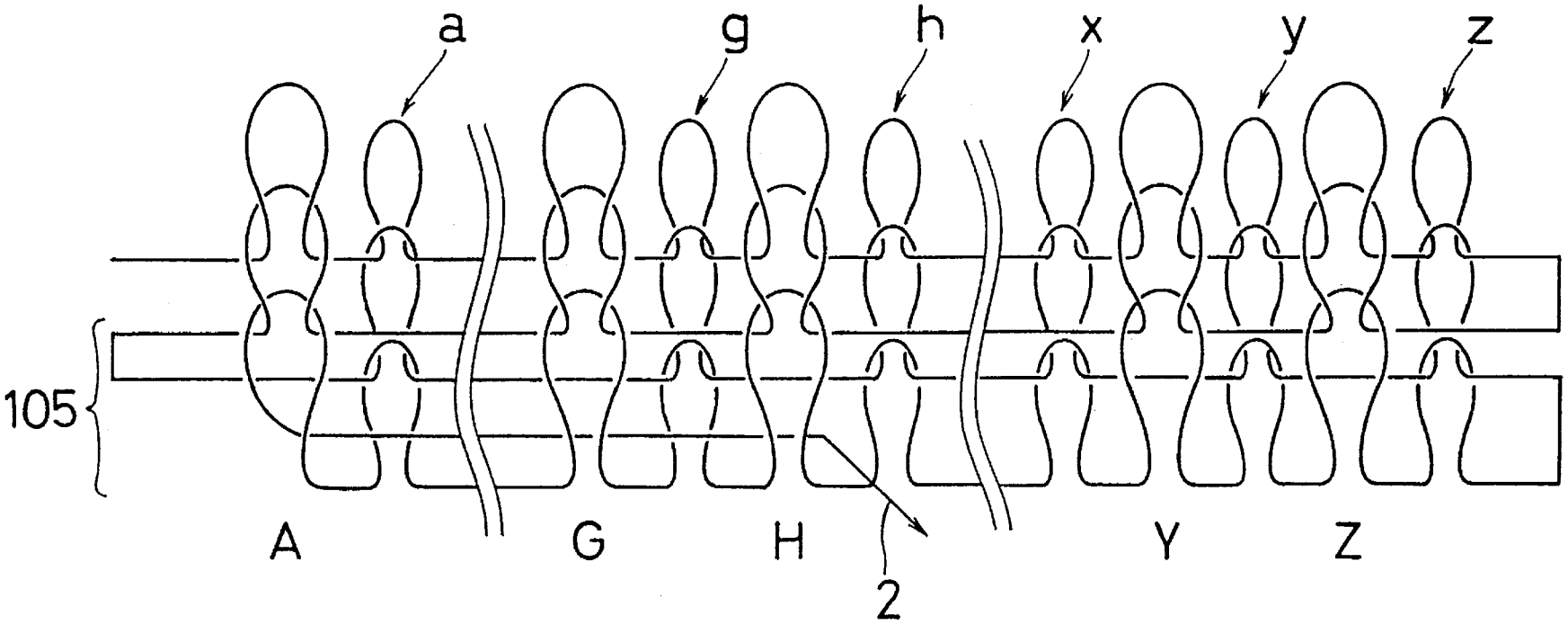
FIG. 9 is a loops diagram showing a method of treating a yarn end of a fabric knitted on the basis of the second embodiment according of the invention.

Next the second embodiment of the method of treating a yarn end will be described. The knit fabric shown in FIG. 1 is used as an example for explanation like the case of the first embodiment. This is because the knitted fabric removed from a knitting machine after the completion of knitting is in the state shown in FIG. 1 or FIG. 2. The same as that of the first embodiment, after the draw yarn has been drawn out in the state of FIG. 7 showing a state after the completion of knitting, the yarn end 2 is pulled in such a direction that the yarn end 2 is drawn out from the knitted fabric (wale direction). The loops formed by the draw yarn 4 are exaggeratedly illustrated for simplification in FIG. 7. In the case of the first embodiment, only the loops knitted as a course 101 in FIG. 3B come to ravel out with the progress of pulling the draw yarn 4. On the other hand, in the case of the second embodiment, after the loops formed as a course 103 in FIG. 4B by needles A through H positioned in a part of the knitting width come to ravel out, the loops of a successively knitted course 104 in FIG. 4C also come to ravel out and are pulled following the yarn end 2 because the loop shape can not be maintained.

Figure 4D:
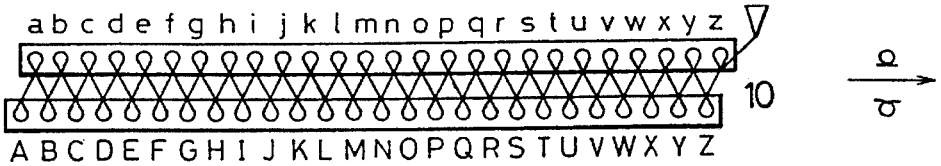
Figure 4E:
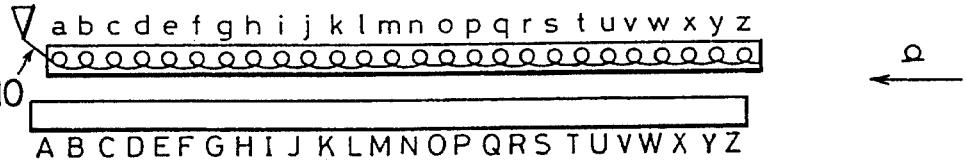
Figure 4F:
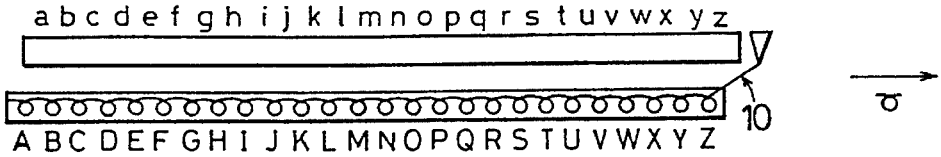
Figure 4G:
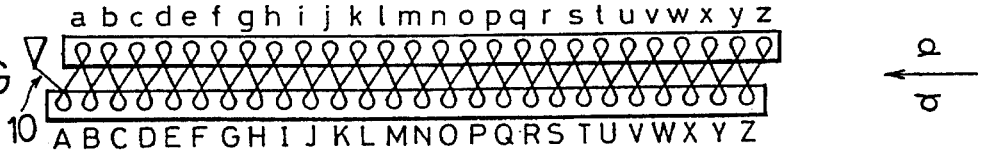

The same as that of the first embodiment, when the raveling-out of a knitted course 105 of rib stitches in FIG. 4D reaches a loop positioned at the needle A of the front needle bed, the raveling-out stops.

To pull the yarn end 2 being further continued, the loops of the course 104 in FIG. 4C come to ravel out because the loop shape thereof can not be maintained. Since a knitting yarn used for knitting a course in FIG. 4C extends between the stitch formed as a course 105 in FIG. 4D by needles of the front needle bed and the stitch formed by needles of the rear needle bed, in the region from the needle A to the needle H wherein stitches are formed in the preceding knitting course 103 in FIG. 4B, the raveled yarn of the course 103 extends in the knitted fabric without being exposed outside the knitted fabric. Further the yarn end 2 exposed outside the knitted fabric for the reason that the loop shape thereof can not be maintained is put into being complicated with a knitted yarn of the course 105 in FIG. 4D in a side end region 106 of the knitted fabric. When, in this state, the yarn end 2 is drawn out from the knitted course 105 in FIG. 4D, the yarn end 2 is put into being exposed outward from a loop formed by the needle H of the front needle bed. And then, when the yarn end is further pulled in such a direction that the yarn end 2 is drawn out from the knitted fabric in the position of the needle H of the front needle bed in such a state that the raveling of the loops is at a stop, the loops of the knitted course in FIG. 4D are tightened for the reason that the raveling-out of the loops is at a stop in a position of the needle A of the front needle bed on a side end of the knitted fabric. The yarn end 2 is cut in a position near the loop formed by the needle H of the front needle bed in such a state that the loops of the knitted course 105 in FIG. 4D are tightened. Thereafter, the knitted course in FIG. 4D is expanded so that the contraction thereof is loosed and the yarn end 2 outside the knitted fabric is pulled into the knitted fabric as the contraction is loosed, and held therein. The yarn end is treated in such manner.

Additionally, in the case where the number of needles fed with a knitting yarn 10 is reduced like the knitted course 103 in FIG. 4B of the second embodiment, a consumption of knitting yarn can be cut. Otherwise, when the needles in the entire knitting width are fed with the knitting yarn 10, the yarn end 2 cut and pulled into the initial portion of the knitted fabric is penetrated the front and rear loops of rib stitches of the knitted course of the initial portion over the entire knitting width, resulting in reinforcing the initial portion (see FIG. 6).

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of treating a yarn end of a machine knit fabric knitted by use of a flat knitting machine having at least a pair of needle beds arranged with a front bed and a rear bed, which can be moved relative to each other in a longitudinal direction, and the knitting needles having a range corresponding with a knitting width for the knit fabric, the method comprising the steps of:

feeding knitting needles from one of the pair of needle beds with a draw yarn;

forming a portion with waste stitches knitted out of the draw yarn;

feeding at least a part of the knitting needles used for knitting the draw yarn with a knitting yarn;

forming an initial portion of the knit fabric starting with a yarn end of the knitting yarn;

feeding the knitting yarn to knitting needles from the front and rear needle beds in a range corresponding with a desired knitting width for the knit fabric;

forming the initial portion of the knit fabric in part with rib stitches from the knitting yarn;

knitting the knit fabric with the desired width and removing the entire knit fabric from the flat knitting machine;

drawing the draw yarn from the portion with waste stitches knitted out of the draw yarn;

pulling the yarn end out of the initial portion formed from the knitting yarn until the initial portion is put into a contracted state;

cutting the pulled-out yarn end in a region near one side of the now contracted initial portion; and expanding the initial portion of the knit fabric to pull the cut yarn end remaining at the initial portion into the initial portion.

2. The method of treating a yarn end of a machine knit fabric of claim 1, further comprising the step of feeding all of the knitting needles used for knitting the draw yarn with the knitting yarn to form the initial portion of the knit fabric.

3. The method of treating a yarn end of a machine knit fabric of claim 1, further comprising the steps of:

positioning a selected number of knitting needles along one side of the knitting width with the selected number of knitting needles less than the number of knitting needles used for knitting the draw yarn; and feeding the selected number of knitting needles with knitting yarn to form the initial portion of the knit fabric.

4. The method of treating a yarn end of a machine knit fabric of claim 1, further comprising the steps of alternately forming a portion with waste stitches knitted from the draw yarn followed by forming an initial portion of the knit fabric starting with the yarn end of the knitting yarn to provide alternating portions of knit fabric formed from the knitting yarn and waste stitches formed from the draw yarn.

5. The method of treating a yarn end of a machine knit fabric of claim 4, wherein each portion formed from the knitting yarn comprises an attachment piece.

6. The method of treating a yarn end of a machine knit fabric of claim 1, further comprising after knitting the initial portion having rib stitches, the steps of:

feeding the knitting needles from one of the needle beds with the knitting yarn;

feeding the knitting needles from the other of the needle beds with the knitting yarn; and knitting tubular stitches to complete the knit fabric.

7. The method of treating a yarn end of a machine knit fabric of claim 1, further comprising the steps of knitting the rib stitches of the initial portion by alternately feeding selected needles from the respective needle beds with the knitting yarn one by one.

8. The method of treating a yarn end of a machine knit fabric of claim 1, further comprising the steps of knitting the rib stitches of the initial portion by alternately feeding selected needles from the respective needle beds with the knitting yarn two by two.

9. A method of treating a yarn end of a machine knit fabric knitted by use of a fiat knitting machine wherein at least a pair of needle beds are provided with front and rear beds which can be moved relative to each other in a longitudinal direction, the method comprising the steps of:

feeding knitting needles from one of the needle beds with a draw yarn and the knitting needles having a range corresponding with a knitting width appropriate for the knit fabric;

forming at least one course of waste stitches out of the draw yarn;

feeding at least a part of the knitting needles used for knitting the draw yarn with a knitting yarn;

forming at least one course of stitches starting with a yarn end of the knitting yarn to form an initial portion of the knit fabric;

subsequently feeding knitting needles from the front and the rear needle beds with the knitting yarn;

initially knitting rib stitches with the knitting yarn;

feeding the knitting needles alternatively from the front and the rear needle beds with the knitting yarn in a series of successive courses while knitting tubular stitches with the knitting yarn to complete the knit fabric;

taking the completed knit fabric from the flat knitting machine;

drawing the draw yarn from the completed knit fabric;

pulling out the yarn end of the knitting yarn remaining at the initial portion of the knit fabric to contract the initial portion;

cutting the pulled-out yarn end in a region near one side of the initial portion which has been contracted; and pulling the cut yarn end back into the initial portion of the knit fabric by expanding the initial portion.

10. The method of treating a yarn end of a machine knit fabric of claim 9, further comprising the steps of positioning a selected number of needles along one side of the knitting width and feeding the selected needles with the knitting yarn to knit the knit fabric with a desired width corresponding to the selected number of needles after knitting the draw yarn.

* * * * *